US005598060A

United States Patent [19]

l'Hermite

[11] Patent Number: 5,598,060

[45] Date of Patent: Jan. 28, 1997

[54] SEGMENTED PHOTOMULTIPLIER TUBE WITH AT LEAST TWO WAYS DISPOSED ON BOTH SIDES OF AN AXIAL PLANE

[75] Inventor: Pierre l'Hermite, Brive, France

[73] Assignee: U.S. Philips Corporation, New York, N.Y.

[21] Appl. No.: 335,540

[22] Filed: Nov. 7, 1994

[30] Foreign Application Priority Data

Nov. 9, 1993 [FR] France ..... 93 13378

[51] Int. Cl.[6] ..... H01J 43/00

[52] U.S. Cl. ..... 313/532; 313/533; 313/537; 313/542; 313/544; 313/524; 313/530

[58] Field of Search ..... 313/532, 533, 313/537, 542, 544, 524, 530; 250/214 JT

[56] References Cited

U.S. PATENT DOCUMENTS 4,871,943 10/1989 Eschard ..... 313/532

4,999,540 3/1991 l'Hermite ..... 313/532

FOREIGN PATENT DOCUMENTS 0428215 5/1991 European Pat. Off. .

*Primary Examiner*—Nimeshkumar Patel

*Attorney, Agent, or Firm*—Arthur G. Schaier

[57] ABSTRACT

A segmented photomultiplier tube having an electrode which, in its higher part acts as a focusing electrode for distributing photo-electrons on both sides of an axial plane, while in its lower part forming a collection cage, the photo-electrons undergo a first multiplication at the portions of the lateral walls, which are folded towards the axial plane. Apertures in a median plate of the electrode are covered by a highly transparent grid. The electrode is completed by a central partition which extends along the median plate just to the proximity of an input dynode of a laminated multiplier. A bar having a small cross-section may be provided, centered on the axial plane and receiving a potential near the potential across the photocathode. A plurality of these tubes can be arranged in a mosaic pattern for mapping luminous events.

19 Claims, 2 Drawing Sheets

SEGMENTED PHOTOMULTIPLIER TUBE WITH AT LEAST TWO WAYS DISPOSED ON BOTH SIDES OF AN AXIAL PLANE

BACKGROUND OF THE INVENTION

1. Field of the Invention

The present invention relates to a segmented photomultiplier tube having at least two multiplication paths, including a sealed envelope having a front face on the inner surface of which a photocathode is provided, and from the latter, arranged one after the other, an electronic optical member providing a division of the photo-electrons in one of the multiplication paths according to their starting position from the photo-cathode, as well as an electron multiplier of the segmented type, having at least one input dynode.

2. Description of the Related Art

A photomultiplier of this type is disclosed in the document EP-A-428 215. This document has more specifically for its object a class of photomultipliers for which the number of paths is not so high and which are of a simple and cheap construction. A major application of this type of photomultipliers is the use as a contiguous mosaic arrangement for determining the positions in space of localized luminous radiation. In the majority of cases these radiations have their origin in scintillators placed in front of each tube. As far as the realization of a segmented photomultiplier (i.e. multi-way) tube remains rather cheap, it can be more economical to use this type of photomultipliers in such applications instead of conventional tubes. Moreover, if the basic photomultipliers of a segmented tube are small, the luminous event can be located with greater precision, provided the segmented tubes used have performances which are as uniform as possible from one tube to the other and from one path to the other. A further point to be taken into account consists in minimizing to the highest possible extent the diaphoty 1 between the paths of one and the same tube.

The segmented tube disclosed in the above-mentioned document, satisfies to a certain extent the structural simplicity looked for because it effects the distribution of the electrons over the different paths according to their starting position from the photo-cathode by means of an electronic optical means whose essential components are common to all the paths.

SUMMARY OF THE INVENTION

The present invention has for its object to provide an improvement in the known photomultiplier tube, more specifically as regards its efficiency in the collection of the photo-electrons. The invention is based on the idea that, instead of directing the photo-electrons towards the input dynode of a laminated multiplier, which dynode has a collection efficiency which is not optimal, preference be given to effecting a first multiplication at a dynode of a solid structure whereafter the secondary electrons be directed to the electron multiplier. As is known, the first dynode plays a major part in the characteristics of a photomultiplier tube.

To that end, a segmented photomultiplier tube constructed in accordance with the invention an electronic optical member comprising an electrode which, in a direction away from the photocathode, includes two consecutive portions: a focusing portion and a collection cage portion, separated by a median plate having at least two apertures arranged on both sides of an axial plane, each of these apertures being covered by a highly transparent grid, the focusing portion having two walls which face the axial plane and are raised towards the photocathode, whilst the collection cage has two lateral edges which face the axial plane and have each a portion that is folded towards the axial plane so as to form a surface intended for effecting a first multiplication of the photo-electrons, and in that the collection cage further includes a partition which is substantially centered on the axial plane and extends from the plate in a direction away from the photo-cathode.

In the photomultiplier tube in accordance with the invention, dividing the electrons emitted by the photocathode according to their starting position, on both sides of the axial plane is effected electronically by a suitable electric field. Consequently, the photomultiplier tube remains of a simple construction. This tube has the advantage that it has a good collection efficiency since the secondary electrons, after their first multiplication at the folded portions of the collection cage, are submitted to the sole action of an extraction field which develops in this cage in response to the voltage applied to the input dynode of the electron multiplier. This voltage is actually higher than the voltage applied to the electrode. The surface on which the first multiplication is performed is not submitted to a retraction field which would push a fraction of these secondary electrodes back towards this same surface.

In accordance with an advantageous embodiment of the invention, the optical member further includes a bar which is substantially centered with respect to the axial plane and is arranged in the focusing portion of the electrode, parallel to the plate from which it is electrically insulated, this bar being intended to receive a potential near the potential of the photocathode. Such an arrangement is favorable for an accurate focusing of the photo-electrons onto the folded portions of the collection cage.

Advantageously, the input dynode of the electron multiplier has edges which face the axial plane and are raised towards and penetrate at least to as far as the end level of the said folded portions. Extracting the electrons after the first multiplication and focusing them onto the input dynode of the multiplier is optimized thereby.

The invention can be applied to obtain a photomultiplier having two paths disposed at either side of the axial plane of the tube, for example symmetrically.

The invention also has for its aim to provide a four-path multiplier, wherein an additional bar likewise having a small cross-section is disposed in the center of the focusing portion of the electrode, perpendicular to the axial plane and parallel to the plate of this portion from which it is electrically insulated, the two bars being electrically interconnected, and in that the electrode further includes an additional partition arranged perpendicular to the axial plane and substantially in the center of the electrode which extends from the plate in a direction away from the photocathode.

According to this embodiment of the invention, the photomultiplier tube can be rendered symmetrical relative to the said axial plane, at each side of which two basic multipliers are disposed, both receiving the electrons from the cathode according to their starting point, as a function of a suitable electric field basically developed by the combined action of the bars of small cross-section which are substantially disposed in the shape of a cross.

BRIEF DESCRIPTIONS OF THE DRAWINGS

For a fuller understanding of the invention, reference is had to the following description taken in connection with the following drawings, in which:

FIG. 1 is a partial schematic, cross-sectional and perspective view of a first example of the photomultiplier tube according to the invention, FIG. 2 is a perspective view of an electrode for a segmented four-path tube, and FIG. 3 is a perspective view of a variant of a bar utilized in the invention.

DETAILED DESCRIPTION OF THE PREFERRED EMBODIMENT

Figure 1:
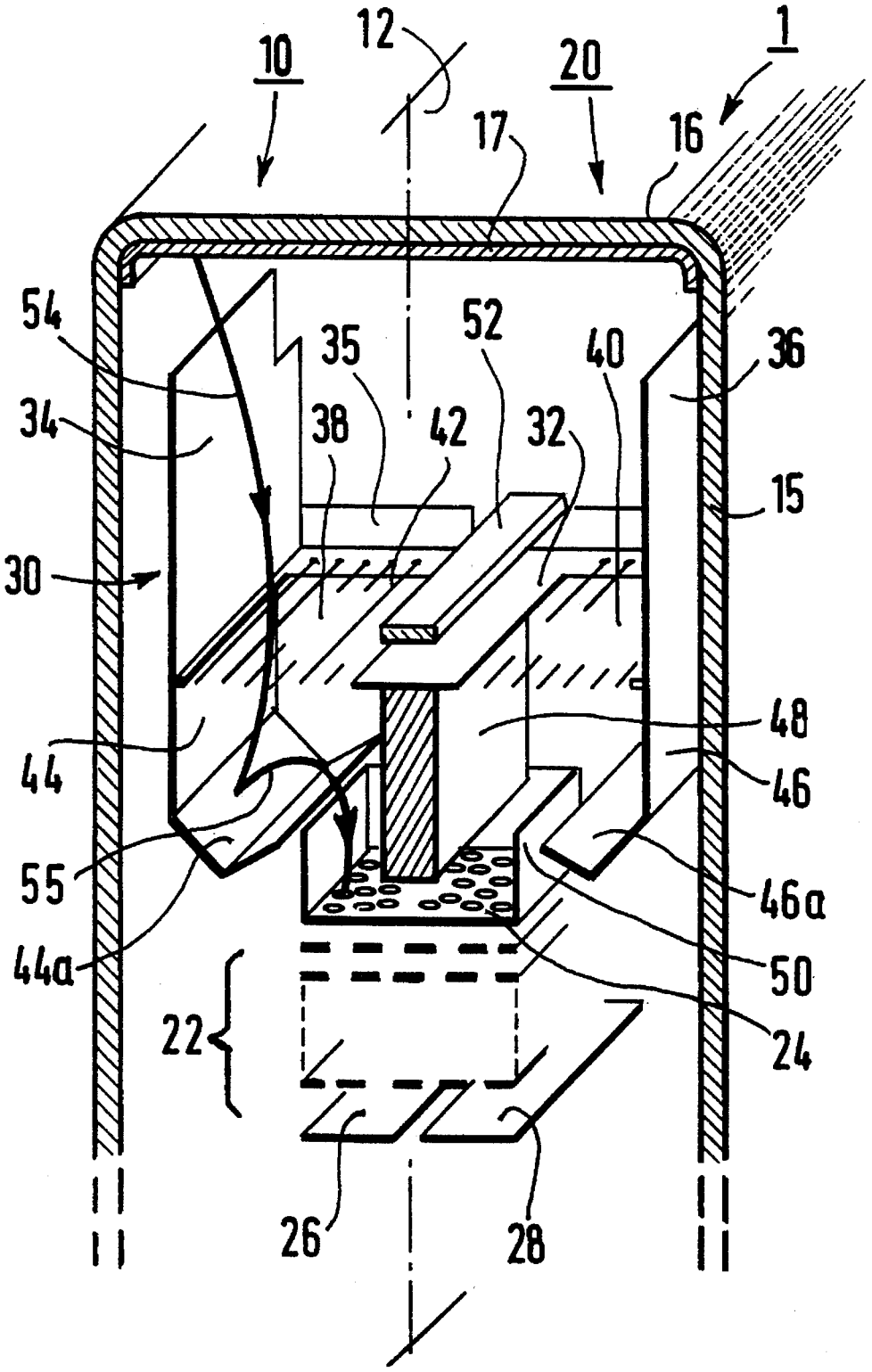

The photomultiplier 1 shown in FIG. 1, comprises two basic photomultipliers 10 and 20, disposed symmetrically with respect to an axial plane 12. It includes a sealed envelope 15 having a front face 16 on whose internal surface a photocathode 17 is disposed. The photomultiplier also includes an electron multiplier 22 of the perforated sheet type which is divided into two symmetrical portions relative to the axial plane 12, in which an input dynode 24 and two anodes 26 and 28 are disposed.

In accordance with the invention, an electronic optical member effects splitting of the photo-electrons towards each of the multiplication paths of the tube according to their starting position from the photocathode, that is to say in the Figure either to the left or to the right of the axial plane 12. The relevant electronic member is constituted by an electrode 30 which in the example comprises a plate 32 of a quadrangular shape which has walls 34 and 36 along each of the two edges of the plate 32 which extend parallel to the axial plane 12, the walls being raised towards the photocathode 17. The plate 32 of this first, focusing portion has two apertures 38 and 40 which are disposed at either side of the axial plane 12 and are each covered by a highly transparent grid 42. As shown in the Figure, this grid can be obtained by wires which are stretched over the circumference of the plate 32, in such a manner as to form a negligible obstacle to the passage of electrons.

The electrode 30 includes a second portion, the collection cage in which the lateral edges 44 and 46 facing the axial plane 12 each end in respective folded portions **44*a* and 46*a*** extending towards the axial plane, for forming a surface intended to realize a first multiplication of the photo-electrons.

The collection cage, or lower portion of the electrode relative to the plate 32, also includes a central partition 48, centered on the axial plane 12 which from the plate 32 extends in a direction away from the photocathode 17. This central partition 48 ends close to the input dynode 24 of the electron multiplier 22. The input dynode 24 has two edges 50 which are raised towards the photo-cathode 17, which preferably penetrate to at least the end level of the folded portions **44*a* and 46*a***.

The electronic optical member is finally completed by a bar 52, here a thin strip, having a small cross-section compared to its length, which is disposed centrally on the axial plane, parallel to and at a slight distance from the plate 32. The bar 52 is electrically insulated from the electrode 30 and is intended to receive a potential near, or equal, to the potential of the photocathode 17.

Such an electronic optical member provides a distribution of the photo-electrons over the two basic photomultipliers 10 and 20. A path is symbolized by the line 54, the first multiplication being mainly effected at the folded portions **44*a*, 46*a* of the lateral edges 44 and 46. The space located under the plate 32 is submitted to a sole electric field obtained by the input dynode 24 of the electron multiplier 22, which input dynode 24 is brought to a potential higher than that of the electrode 30. The difference in potential between the dynode 24 and the electrode 30 is, for example, 100 volts. Thus, an extractor field is created for taking-off the secondary electrons after multiplication at the folded portions 44*a* and 46*a*, which field, under the influence of the central partition 48, directs these secondary electrons towards the input dynode 24 of the multiplier 22. A secondary electron path is represented by the line 55**.

A segmented photomultiplier of this type has a better collection efficiency than the photomultiplier of the prior art, because the first multiplication occurs at a dynode of a solid structure, the multiplication efficiency being at its maximum. As is known, the first multiplication plays a leading part in a photomultiplier.

Figure 2:
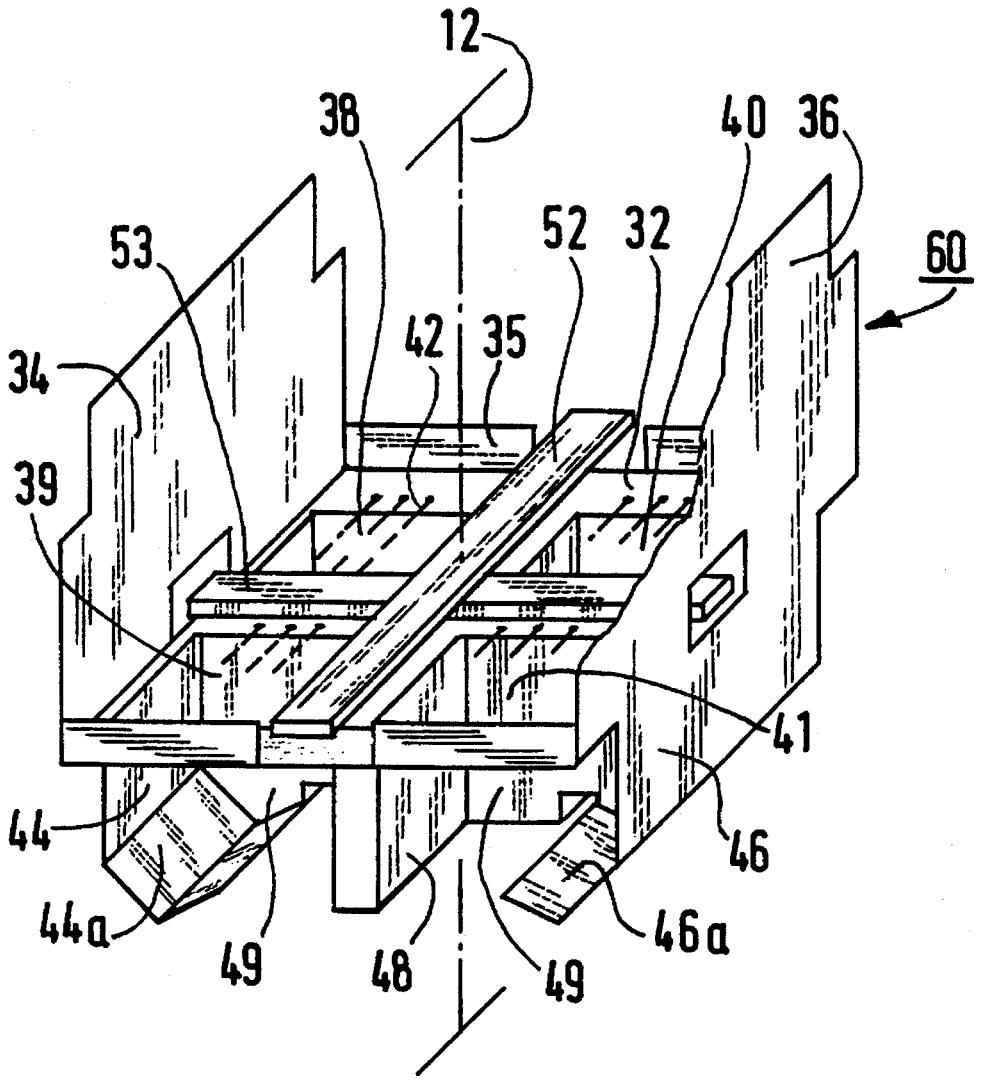

FIG. 2 illustrates a further embodiment of the invention, relating to a segmented, four-path photomultiplier tube. In this Figure only that portion of the tube is shown that relates to the electronic optical means, that is to say basically the electrode providing the distribution of the photo-electrons over the four ways. As far as possible, the elements having the same functions as those given in the example with reference to FIG. 1, have been given the same reference numerals.

The electrode 60 shown, has a focusing portion with a quadrangular plate 32 having two walls 34, 36 which extend parallel to the axial plane 12 and which are raised towards the photocathode. The plate 32 has four apertures 38, 39, 40 and 41 placed two by two symmetrically with respect to the axial plane 12. The apertures 38 and 39, or 40 and 41, of the same side of the axial plane 12, are separated by an additional partition 49 which extends from the plate 32 in a direction away from the photocathode, i.e. towards the bottom of FIG. 2. This additional partition 49 is located in the center of the electrode 60 and defines together with the first partition 49 of the type as described with reference to FIG. 1, the space in which the photoelectrons are distributed over the four independent ways. Also here each aperture 38–41 is covered by a highly transparent grid formed, for example, by wires 42 which are stretched in the plane of the plate 32.

The electrode 60 has a portion located below the level of the plate 32, denoted collection cage hereinbefore, which has lateral edges 44, 46 facing the axial plane 12, whose ends include portions **44*a* and 46*a*, respectively, which are folded towards the axial plane 12**. Also here these folded portions form a surface intended to realize a first multiplication of the photo-electrons. They consequently play the part of the first dynode in the photomultiplier tube.

As in the example described with reference to FIG. 1, a bar 52 having a small cross-section is disposed near the plate 32 and is centered on the axial plane 12, this bar being intended to receive a potential near to the potential of the photocathode. Thus, this bar 52 contributes to obtaining a suitable electric field for effecting the distribution of the photo-electrons on both sides of the axial plane 12. In a similar manner, an additional bar 53, similar to the bar 52, is disposed in the midway point of the electrode 60, but perpendicularly to the axial plane 12. The bars 52 and 53 are electrically interconnected, the additional bar 53 being positioned parallel to the plate 32 at a slight distance and insulated therefrom. The additional bar 53 provides a distribution of the electric field which, parallel to the axial plane 12, will be suitable to effect the distribution of the photo-electrons over either the one or the other of the apertures 38 or 39, according to their starting position from the photocathode. The same applies for the distribution of the photo-electrons over the apertures 40 or 41 depending on their starting position.

In the example described with reference to FIG. 1, as well as in the description of FIG. 2, the plate 32 of the electrode has also walls 35 placed perpendicularly to the axial plane 12, these walls having a height less than the heights of the raised walls 34, 36. Thus, a suitable electric field is realized for distributing the photo-electrons over both sides of the axial plane 12.

Figure 3:
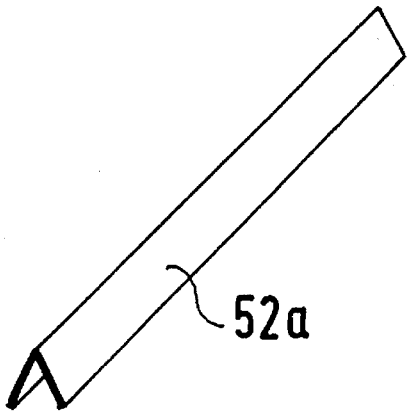

In the previously described examples, the bars have been represented by flat strips, but any other shape is also possible, for example strips such as those shown at 52*a* in FIG. 3, which are folded lengthwise in the shape of a V, whose base will in a position pointing towards the photocathode.

Other modifications of the features of the invention are within the grasp of a person skilled in the an and remain within the scope of the invention claimed hereafter.

I claim:

1. A segmented photomultiplier tube having at least two multiplication paths, including a sealed envelope having a front face on the inner surface of which a photocathode is provided, and from the latter, arranged one after the other, an electronic optical means providing a division of photo-electrons in one of the multiplication paths according to their starting position from the photocathode, as well as an electron multiplier of the segmented type, having at least one input dynode, wherein said electronic optical means comprises an electrode which, in a direction away from the photo-cathode, includes a focusing portion and a collection cage portion, said focusing portion and said collection cage portion separated by a median plate, said median plate having at least two apertures with at least one aperture arranged on each respective side of an axial plane, each of these apertures being covered by a highly transparent grid, the focusing portion having two walls which face the axial plane and are raised towards the photocathode, whilst the collection cage has two lateral edges which face the axial plane and have a portion that is folded towards the axial plane so as to form a surface intended for effecting a first multiplication of the photo-electrons, and in that said collection cage further includes a partition which is substantially centered on the axial plane and extends from the plate in a direction away from the photocathode.

2. A photomultiplier as claimed in claim 1, wherein said optical means further includes a bar which is substantially centered with respect to the axial plane and is arranged in the focusing portion of the electrode, parallel to said plate from which it is electrically insulated, this bar being intended to receive a potential near the potential of the photocathode.

3. A photomultiplier as claimed in claim 2, including four multiplication paths and an additional bar disposed in the center of the focusing portion of the electrodes, perpendicularly to the axial plane and parallel to the plate of this portion from which it is electrically insulated, the two bars being electrically interconnected, and in that the electrode further includes an additional partition arranged perpendicularly to the axial plane and substantially in the center of the electrode which extends from the plate in a direction away from the photocathode.

4. A photomultiplier tube as claimed in claim 3 wherein the bar is in the shape of a strip having a rectangular cross-section.

5. A photomultiplier tube as claimed in claim 3, wherein the bar is constituted by a strip which is folded in the longitudinal direction so as to form a V-section whose folded base extends towards the photocathode.

6. A photomultiplier tube as claimed in claim 2, wherein the bar is in the shape of a strip having a rectangular cross-section.

7. A photomultiplier tube as claimed in claim 2, wherein the bar is constituted by a strip which is folded in the longitudinal direction so as to form a V-section whose folded base extends towards the photocathode.

8. A photomultiplier as claimed in claim 2, wherein the input dynode of the electron multiplier has edges which face the axial plane and are raised towards and penetrate at least to as far as the end level of the said folded portions.

9. A photomultiplier as claimed in claim 2, wherein the focusing portion of the electrode has walls other than the said raised walls facing the axial plane, whose height in the direction towards the photocathode is less than the height of the said raised edges.

10. A photomultiplier as claimed in claim 1, wherein the input dynode of the electron multiplier has edges which face the axial plane and are raised towards and penetrate at least to as far as the end level of the said folded portions.

11. A photomultiplier as claimed in claim 10, wherein the focusing portion of the electrode has walls other than the said raised walls facing the axial plane, whose height in the direction towards the photocathode is less than the height of the said raised edges.

12. A photomultiplier as claimed in claim 1, wherein the focusing portion of the electrode has walls other than the said raised walls facing the axial plane, whose height in the direction towards the photocathode is less than the height of the said raised walls.

13. A segmented photomultiplier tube comprising:

at least two multiplication paths, a sealed envelope having an inner surface on which a photocathode is disposed;

electronic optical means for dividing photo-electrons into at least one of said multiplication paths from a starting position; and an electron multiplier having at least one input dynode;

wherein said electronic optical means comprises an electrode including a focusing portion and a collection cage portion, said focusing portion and said collection cage portion separated by a median plate; said median plate having at least two apertures, with at least one of said apertures being arranged on each respective side of an axial plane and covered by a transparent grid, the focusing portion having two walls facing and raised towards the photocathode, the collection cage having two lateral edges facing the axial plane and having a respective portion folded towards the axial plane so as to form a surface for effecting a first multiplication of the photo-electrons, said collection cage further including a partition at least substantially centered on the axial plane and extending from the plate in a direction away from the photocathode.

14. The photomultiplier as claimed in claim 13, wherein said optical means includes a bar for receiving a potential near the potential of the photocathode, said bar being at least substantially centered relative to the axial plane, arranged in the focusing portion of the electrode and parallel to said plate from which it is electrically insulated.

15. The photomultiplier as claimed in claim 14, and including four multiplication paths and an additional bar disposed in the center of the focusing portion of the electrodes and perpendicular to the axial plane and parallel to the plate of this portion from which it is electrically insulated; said bar and said additional bar being electrically interconnected, and wherein the electrode further includes an additional partition arranged perpendicular to the axial plane and substantially in the center of the electrode which extends from the plate in a direction away from the photocathode.

16. The photomultiplier tube as claimed in claim 14, wherein the bar is in the shape of a strip having a rectangular cross-section.

17. The photomultiplier tube as claimed in claim 14, wherein the bar is a strip which is folded in the longitudinal direction so as to form a V-section having a folded base extending towards the photocathode.

18. The photomultiplier as claimed in claim 13, wherein the input dynode of the electron multiplier has edges facing the axial plane and raised towards and penetrate at least to as far as the end level of said folded portions.

19. The photomultiplier as claimed in claim 13, wherein the focusing portion of the electrode includes additional walls facing the axial plane, said additional walls having a height in the direction towards the photocathode and less than the height of the said raised walls.

* * * * *